US009671154B1

(12) United States Patent
Shrader et al.

(10) Patent No.: US 9,671,154 B1
(45) Date of Patent: Jun. 6, 2017

(54) STORAGE UNITS

(71) Applicant: Electrolux Home Products, Inc., Charlotte, NC (US)

(72) Inventors: Benjamin Paul Shrader, Charlotte, NC (US); Brent Aaron Curtis, Terrell, NC (US); Cristhian Camacho, Curitiba (BR); Ramom Eduardo Gadens Baduy, Curitiba (BR); Israel Mercer Neto, Curitiba (BR)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/048,221

(22) Filed: Feb. 19, 2016

(51) Int. Cl.
*F25D 23/00* (2006.01)
*F25D 23/04* (2006.01)
*B65D 25/04* (2006.01)

(52) U.S. Cl.
CPC ..... *F25D 23/04* (2013.01); *B65D 25/04* (2013.01)

(58) Field of Classification Search
CPC ..... F25D 23/028; F25D 23/04; F25D 23/02; F25D 23/025; F25D 29/005
USPC ..... 312/405, 321.5, 405.1
See application file for complete search history.

(56) References Cited

U.S. PATENT DOCUMENTS 2,955,006 A * 10/1960 White ..... F25D 23/04 211/150
3,625,371 A 12/1971 Dill
5,513,910 A 5/1996 Ellingwood et al.
6,126,257 A 10/2000 Carpenter et al.
D479,537 S 9/2003 Bodine et al.
7,232,194 B2 6/2007 Becke et al.
7,240,517 B2 7/2007 Barak
7,334,853 B2 2/2008 Ahmed et al.
7,350,647 B2 4/2008 Haller et al.
8,056,997 B2 11/2011 Baek
8,147,016 B2 4/2012 Kwon
8,220,886 B2 7/2012 Han et al.
8,336,976 B2 12/2012 Lee
8,376,483 B2 2/2013 Jung
8,746,818 B2 6/2014 Meese
(Continued)

FOREIGN PATENT DOCUMENTS

CN 102494505 6/2012
DE 102013205306 10/2014
(Continued)

OTHER PUBLICATIONS

CN 203501649; abstract and figure; Mar. 2014; Cai et al.*

*Primary Examiner* — Janet M Wilkens
(74) *Attorney, Agent, or Firm* — Pearne & Gordon, LLP

(57) ABSTRACT

A storage unit can include a front wall, a rear wall and a divider selectively locatable at at least three positions between the front wall and the rear wall, thereby defining at least three distinct storage areas. The front wall can include a front wall free edge that is structured to support and retain obliquely and spaced away from one another in a storage area between the front wall and the divider upper portions of at least two of a first group of substantially cylindrical articles. The divider can include a divider free edge that is structured to support and retain obliquely and spaced away from one another in a storage area between the divider and the rear wall upper portions of at least two of a second group of substantially cylindrical articles.

15 Claims, 3 Drawing Sheets

(56) References Cited

U.S. PATENT DOCUMENTS

| | | | | |
|---|---|---|---|---|
| 2006/0010829 | A1 | 1/2006 | de Sa Cavalcanti et al. | |
| 2008/0272078 | A1* | 11/2008 | Belokin | A47F 5/08 211/126.1 |
| 2009/0033191 | A1 | 2/2009 | Kim | |
| 2012/0024005 | A1 | 2/2012 | Kouyoumdjian et al. | |
| 2012/0255322 | A1 | 10/2012 | Han et al. | |
| 2013/0162133 | A1* | 6/2013 | Arslankiray | F25D 31/007 312/405 |

FOREIGN PATENT DOCUMENTS

| | | |
|---|---|---|
| EP | 0937223 | 8/1999 |
| EP | 1239245 | 9/2002 |
| EP | 2784418 | * 10/2014 |
| JP | 2001074359 | 3/2001 |
| KR | 20020057633 | 7/2002 |
| WO | 0214761 | 2/2002 |
| WO | 2009125560 | 10/2009 |
| WO | 2012010581 | * 1/2012 |

* cited by examiner

STORAGE UNITS

FIELD OF THE INVENTION

The present invention relates generally to storage units that can provide for the compact storage of containers such as cans and bottles for example and, more particularly, to storage units that can be converted between providing for the particular storage of such containers and providing for the general storage of other articles.

BACKGROUND OF THE INVENTION

Containers such as bottles and cans are typically stored at facilities such as the insides of doors of refrigeration appliances for example in an upright fashion, thereby in some instances occupying vertical storage space that can be limited. Therefore, it would be desirable to provide for the storage of such containers in a compact manner that restricts the vertical space that they occupy individually and allows for easy accessibility to the containers. In addition, it would be useful to provide for such storage of the containers at a storage unit or storage location that can be converted between providing for the particular storage of the containers and providing for the more general storage of other articles.

BRIEF SUMMARY OF THE INVENTION

The following presents a simplified summary of the invention in order to provide a basic understanding of some aspects of the invention. The summary does not represent an extensive overview of the invention, nor is the summary intended to identify key or critical elements of the invention or delineate the scope of the invention. The sole purpose of the summary is to present certain concepts of the invention in a simplified form as a prelude to the descriptions of examples and embodiments of the invention that are presented hereinafter.

According to one aspect, a storage unit can include at least a front wall, a rear wall and a bottom wall. The storage unit also can include a divider that is selectively locatable in one of three positions comprising: a first position overlying the bottom wall, thereby defining a first storage area between at least the front wall and the rear wall; a second position between the front wall and the rear wall and inclined away from the rear wall and toward the front wall, thereby defining a second storage area with at least the front wall and defining a third storage area with at least the rear wall; and a third position adjacent the rear wall, thereby at least diminishing the size of the third storage area and enlarging the size of the second storage area. In a particular embodiment of this aspect, the bottom wall can be structured to retain obliquely to a horizontal surface and spaced away from one another at the second storage area lower portions of at least two of a first group of substantially cylindrical articles. Together with this particular embodiment, or with a bottom wall not so structured, the front wall can include a front wall free edge that is structured to support and retain obliquely to a horizontal surface and spaced away from one another at the second storage area upper portions of the at least two of a first group of substantially cylindrical articles. Also, together with at least one of the bottom wall being structured to retain obliquely the first group of cylindrical articles and the front wall having a free edge structured to retain obliquely the first group of cylindrical articles, or together with a bottom wall and a front wall not so structured, the divider can include a divider free edge that is structured to support and retain obliquely to a horizontal surface and spaced away from one another at the third storage area upper portions of at least two of a second group of substantially cylindrical articles. The divider free edge can include at least one access opening at which one of an individual's finger and a tool can be inserted and the divider thereby selectively located at one of the first position, the second position and the third position.

According to another aspect, the storage unit can include: a first side wall having a first side wall first lateral end and a first side wall second lateral end; and a second side wall having a second side wall first lateral end and a second side wall second lateral end. The front wall can include a front wall first lateral end and a front wall second lateral end with the front wall free edge extending between the front wall first lateral end and the front wall second lateral end. The rear wall can include a rear wall first lateral end and a rear wall second lateral end. The first side wall first lateral end can be joined to the front wall first lateral end and the first side wall second lateral end can be joined to the rear wall first lateral end. The second side wall first lateral end can be joined to the front wall second lateral end and the second side wall second lateral end can be joined to the rear wall second lateral end. The divider can include a divider first lateral side and a divider second lateral side. The divider can be pivotally connected at at least one of a first pivotal connection between the divider first lateral side and the first side wall and a second pivotal connection between the divider second lateral side and the second side wall.

According to a further aspect, the first pivotal connection can include a first pivot rod that is connected at the divider first lateral side and extends outwardly from the divider first lateral side into a first side wall pivot structure at the first side wall, and the second pivotal connection can include a second pivot rod that is connected at the divider second lateral side and extends outwardly from the divider second lateral side into a second side wall pivot structure at the second side wall, whereby the divider can be selectively locatable at one of the first position, the second position and the third position by pivotal movement of the divider. In a particular example of this further aspect, the first side wall pivot structure can include a first side wall first pivot point and a first side wall second pivot point. The first side wall first pivot point and the first side wall second pivot point can have a configuration similar to the configuration of the first pivot rod and can be joined by a first slot that is sufficiently large for the first pivot rod to move between the first side wall first pivot point and the first side wall second pivot point. The second side wall pivot structure can include a second side wall first pivot point and a second side wall second pivot point. The second side wall first pivot point and the second side wall second pivot point can have a configuration similar to the configuration of the second pivot rod and can be joined by a second slot that is sufficiently large for the second pivot rod to move between the second side wall first pivot point and the second side wall second pivot point.

According to an additional aspect, the storage unit can include at least one of a first abutment located at the first side wall within the first storage area and a second abutment located at the second side wall within the first storage area. The first abutment and the second abutment can support and retain the divider at the second position. In connection with this additional aspect, the divider can include at least one of a first recess at the divider first lateral side and a second recess at the divider second lateral side. The first recess can be located at the divider first lateral side such that the first abutment passes through the first recess when the first pivot rod is at the first side wall first pivot point and the divider is moved past the first abutment; and the first abutment can engage the divider and support and retain the divider at the second position when the first pivot rod is at the first side wall pivot seat second pivot point. The second recess can be located at the divider second lateral side such that the second abutment passes through the second recess when the second pivot rod is at the second side wall first pivot point and the divider is moved past the second abutment; and the second abutment can engage the divider and support and retain the divider at the second position when the second pivot rod is at the second side wall seat second pivot point. In an example of this additional aspect, the first side wall second pivot point can be located nearer the rear wall than the first side wall first pivot point and the second side wall second pivot point can be located nearer the rear wall than the second side wall first pivot point.

According to yet a further aspect, a storage unit can include a front wall, a rear wall and a divider locatable between the front wall and the rear wall and inclinable away from the rear wall and toward the front wall. The front wall can include a front wall free edge that is structured to support and retain obliquely to a horizontal surface and spaced away from one another in a storage area between the front wall and the divider upper portions of at least two of a first group of substantially cylindrical articles. Additionally, the divider can include a divider free edge that is structured to support and retain obliquely to a horizontal surface and spaced away from one another in a storage area between the divider and the rear wall upper portions of at least two of a second group of substantially cylindrical articles. In an example of this further aspect, the storage unit can include a bottom wall that is structured to support and retain obliquely to a horizontal surface and spaced away from one another in the storage area between the front wall and the divider lower portions of at least two of a first group of substantially cylindrical articles.

With respect to all of the foregoing aspects, embodiments and examples, the storage unit can be included at a refrigeration appliance and, in a particular instance, the storage unit can be located at the inside of a door provided at the refrigeration appliance for opening and closing access to the interior of the refrigeration appliance.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
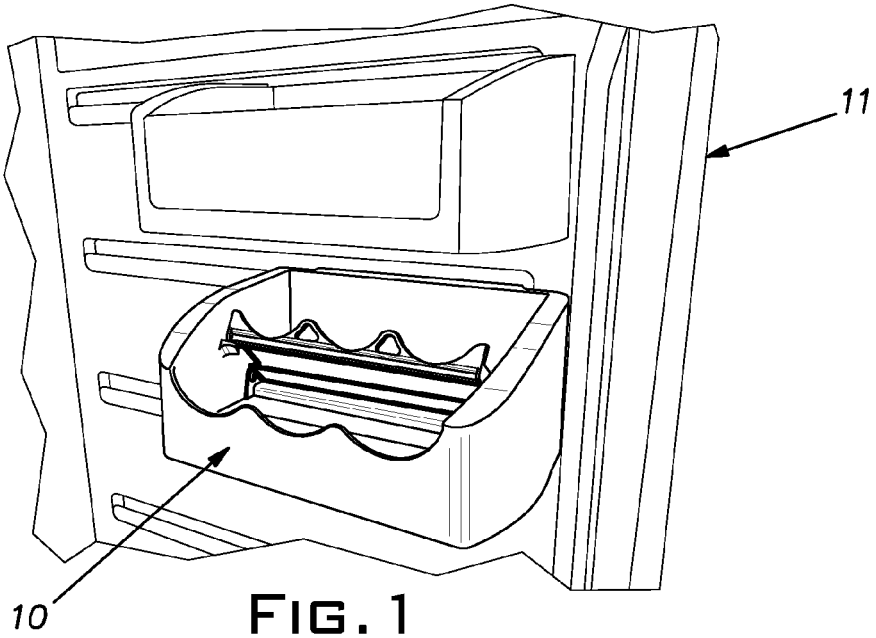
FIG. 1 is a perspective view of an example of the present invention comprising a storage unit installed at the inside of a refrigerator door.

The present invention will now be described with reference to the drawings, wherein like reference numerals are used to refer to like elements throughout. It is to be appreciated that the various drawings are not necessarily drawn to scale from one figure to another or within a given figure. Also, the sizes of the components are somewhat arbitrarily drawn in order to facilitate an understanding of the drawings. In the following description, numerous specific details are set forth in order to provide a thorough understanding of the present invention, but it can be possible in certain instances to practice the present invention without those specific details.

Referring to FIG. 1, there is shown an example of the present invention including a storage unit, indicated generally at 10, installed at the inside of a door 11 of a refrigeration appliance such as a household refrigerator for example, which storage unit is shown in one of its three storage modes as hereinafter described. It will be understood by those having ordinary skill in the art upon reading the description of the examples and embodiments of the invention that follow that the invention is not limited to storage units applied at the insides of refrigerator doors but can be applied in other contexts. For example, the storage units of the present invention can be applied to pantries and other facilities provided for the storage of articles.

In the example of FIG. 1, the storage unit 10 is shown in one of its storage modes in which the storage unit is adapted to support and retain obliquely to a horizontal surface and spaced away from one another in two separate storage areas substantially cylindrical articles such as substantially cylindrical cans and/or bottles for example. In this mode, the storage unit 10 provides for the compact storage of articles such as cans and bottles, for example, while limiting the vertical storage area occupied by the articles. As used herein, the expressions "oblique" and "obliquely" are intended to refer to a spatial aspect that is neither perpendicular nor parallel to a horizontal line or surface.

Figure 2:
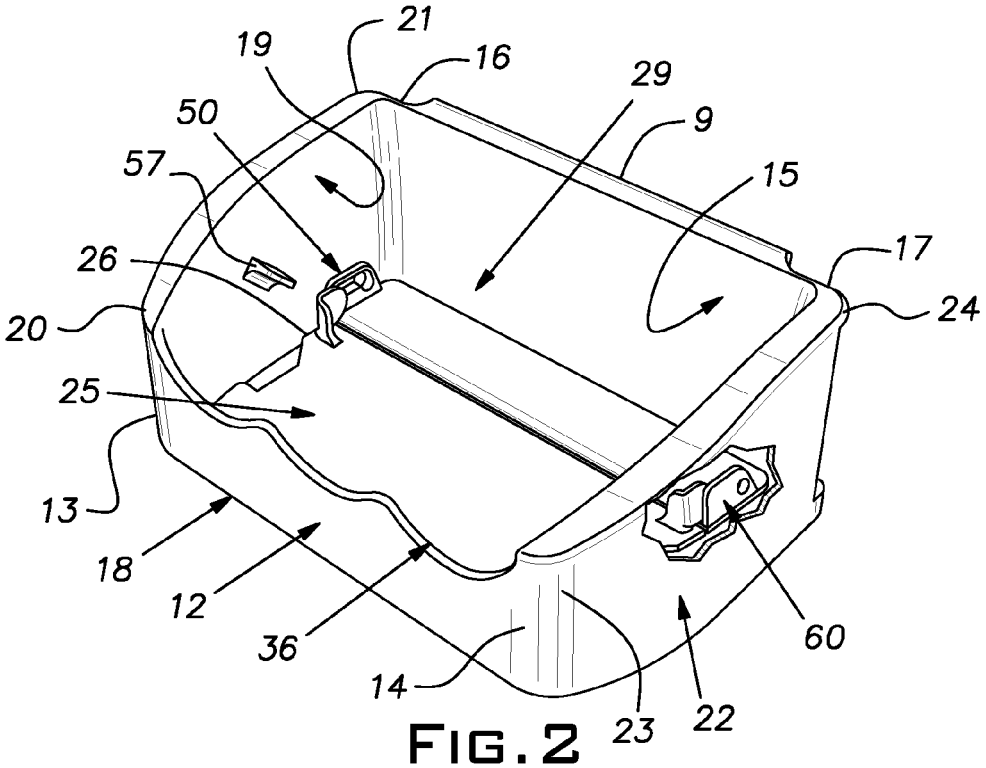
FIG. 2 is a perspective view, including a broken-out section, of the storage unit of FIG. 1 arranged in a first storage mode.
Figure 3:
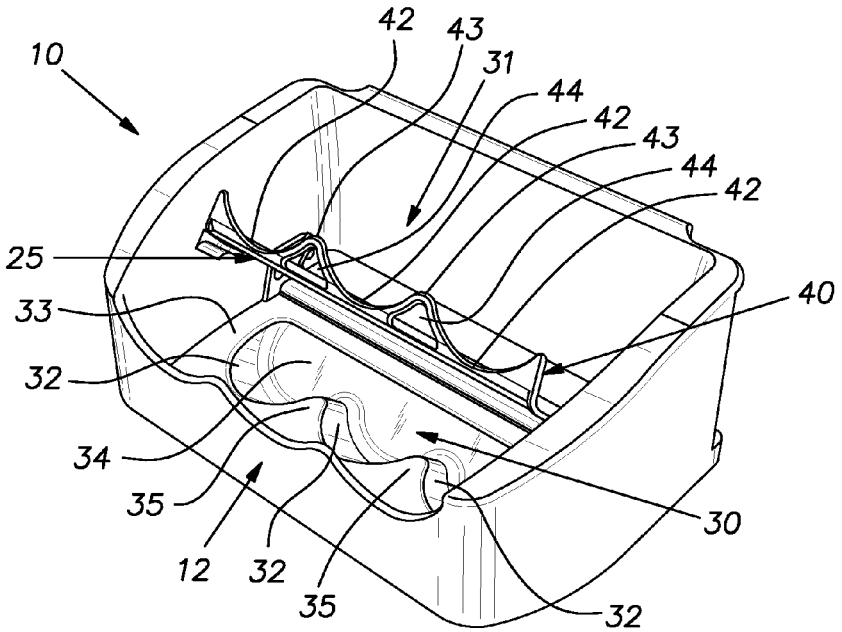
FIG. 3 is a perspective view of the storage unit of FIG. 1 arranged in a second storage mode.
Figure 4:
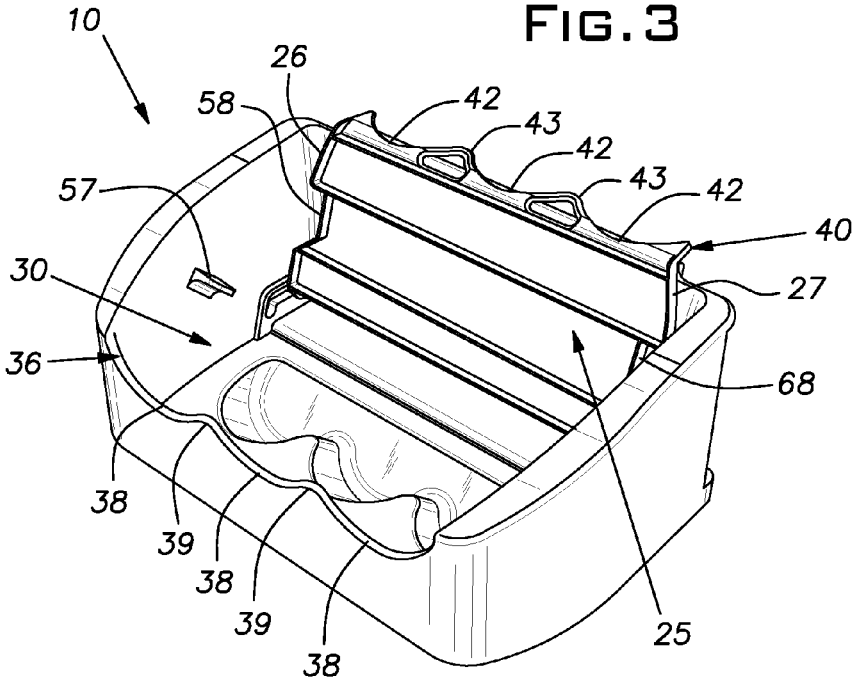
FIG. 4 is a perspective view of the storage unit of FIG. 1 arranged in a third storage mode.

Considering now the functionality of the storage unit 10 in providing for three different modes of storing articles, reference is made to FIGS. 2, 3 and 4 of the drawings which represent examples of three storage modes that are available with the storage unit 10. In these three figures, the storage unit 10 is shown to include a front wall, indicated generally at 12, a rear wall, indicated generally at 15, a bottom wall, indicated generally at 18, a first side wall, indicated generally at 19, and a second side wall, indicated generally at 22. In the example shown in FIG. 1, the storage unit 10 is mounted to the inside of the door 11 by means of a hook-like structure 9 that extends along the top of the rear wall 15 and is hooked onto a complementary ledge at the inside of the door 11. The storage unit 10 also includes a divider, indicated generally at 25, that includes a divider first lateral side 26 and a divider second lateral side 27 (see FIG. 4) and is selectively locatable within the confines of the front wall 12, the rear wall 15, the bottom wall 18, the first side wall 19 and the second side wall 22.

The first side wall 19 includes a first side wall first lateral end 20 and a first side wall second lateral end 21, and the second side wall 22 includes a second side wall first lateral end 23 and a second side wall second lateral end 24. The front wall 12 includes a front wall first lateral end 13 and a front wall second lateral end 14. A front wall free edge, indicated generally at 36, extends between the front wall first lateral end 13 and the front wall second lateral end 14. The rear wall 15 includes a rear wall first lateral end 16 and a rear wall second lateral end 17. The first side wall first lateral end 20 is joined to the front wall first lateral end 13 and the first side wall second lateral end 21 is joined to the rear wall first lateral end 16. The second side wall first lateral end 23 is joined to the front wall second lateral end 14 and the second side wall second lateral end 24 is joined to the rear wall second lateral end 17.

In FIG. 2, the divider is shown as selectively locatable in a manner described in greater detail below at a first position overlying the bottom wall 18, thereby defining a first storage area, indicated generally at 29, between at least the front wall 12 and the rear wall 15. In this storage mode, the first storage area 29 presents an open bin with an essentially level bottom, whereby articles of essentially any configuration can be stored at the storage unit 10 within the expanse of the first storage area 29.

In FIG. 3, the storage unit 10 is shown in a second storage mode in which the divider 25 is selectively locatable in a manner described in greater detail below at a second position between the front wall 12 and the rear wall 15 and inclined away from the rear wall 15 and toward the front wall 12. In this second position, the divider 25 defines a second storage area, indicated generally at 30, with at least the front wall 12, and a third storage area, indicated generally at 31, with at least the rear wall 15.

In FIG. 4, the storage unit 10 is shown in a third storage mode in which the divider 25 is selectively locatable in a manner described in greater detail below at a third position adjacent the rear wall 15. The selective location of the divider 25 in the third position diminishes the size of the third storage area 31, to the point of eliminating the third storage area if desired, and enlarges the size of the second storage area 30, thereby making the articles stored in the second storage area 30 more readily accessible.

As best shown in FIGS. 3 and 4, the bottom wall 18 is structured to support and retain obliquely to a horizontal surface and spaced away from one another at the second storage area 30 lower portions of at least two of a first group of substantially cylindrical articles. Thus, in the example of FIGS. 3 and 4, the bottom wall 18 includes three pockets or cavities 32 that have a substantially cylindrical configuration and extend obliquely to a horizontal surface between an upper surface 33 and a lower surface 34 of the bottom wall 18. The three pockets 32 are separated from one another by bottom wall portions 35. As a result, the lower portions of substantially cylindrical articles, such as cans for example, placed within the pockets 32 are supported and retained at the second storage area 30 obliquely to a horizontal surface and out of contact with one another.

The support and retention of upper portions of the substantially cylindrical articles at the second storage area 30 can be aided by the structure of the front wall 12. Specifically, the front wall free edge 36 can be structured to support and retain obliquely to a horizontal surface and spaced away from one another at the second storage area 30 upper portions of the at least two of the first group of substantially cylindrical articles. Thus, when structured in this manner, the front wall free edge 36 of the front wall 12 includes three substantially circular cut-out portions 38, for example, each of which is arranged in line with a respective pocket of the several pockets 32. The substantially circular cut-out portions 38 of the front wall free edge 36 are separated from one another by front wall projections 39. As a result, the upper portion of a substantially cylindrical article placed within a pocket 32 in the bottom wall 18 can rest at the substantially circular cut-out portion 38 of the front wall free edge 36 that is in line with that pocket and thereby be supported and retained obliquely to a horizontal surface.

The support and retention of substantially cylindrical articles obliquely to a horizontal surface at the third storage area 31 can be facilitated by the structure of the divider 25. Specifically, the divider 25 can include a divider free edge, indicated generally at 40, that is structured to support and retain obliquely to a horizontal surface and spaced away from one another at the third storage area 31 the upper portions of at least two of a second group of substantially cylindrical articles. Thus, the divider free edge 40 can have the shape of a plurality of undulant surfaces comprising valleys 42, that are substantially circular in configuration, and peaks 43 so that substantially cylindrical articles can be placed in the third storage area such that the upper portions of the articles rest in the valleys 42 and the bottom portions of the articles extend obliquely to a horizontal surface downwardly into the third storage area 31. The bottom wall 18 in the third storage area 31 can be configured in the same manner as the bottom wall is configured in the second storage area 30 so as to have pockets as described above if desired.

The divider free edge 40 can include at least one access opening at which one of an individual's finger and a tool can be inserted and the selective location of the divider thereby facilitated in a manner described in greater detail below. In the example shown in the figures, two access openings 44 are provided at the peaks 43 at the divider free edge 40.

Proceeding now to a description of the structure provided in the example storage unit for selectively locating the divider 25 in the first position, as shown in FIG. 2, the second position, as shown in FIG. 3, and the third position, as shown in FIG. 4, it is first noted that the divider 25 is pivotally connected at at least one of a first pivotal connection, indicated generally at 50, between the divider first lateral side 26 and the first side wall 19 and a second pivotal connection, indicated generally at 60, between the divider second lateral side 27 and the second side wall 22 (see FIG. 1).

Figure 5:
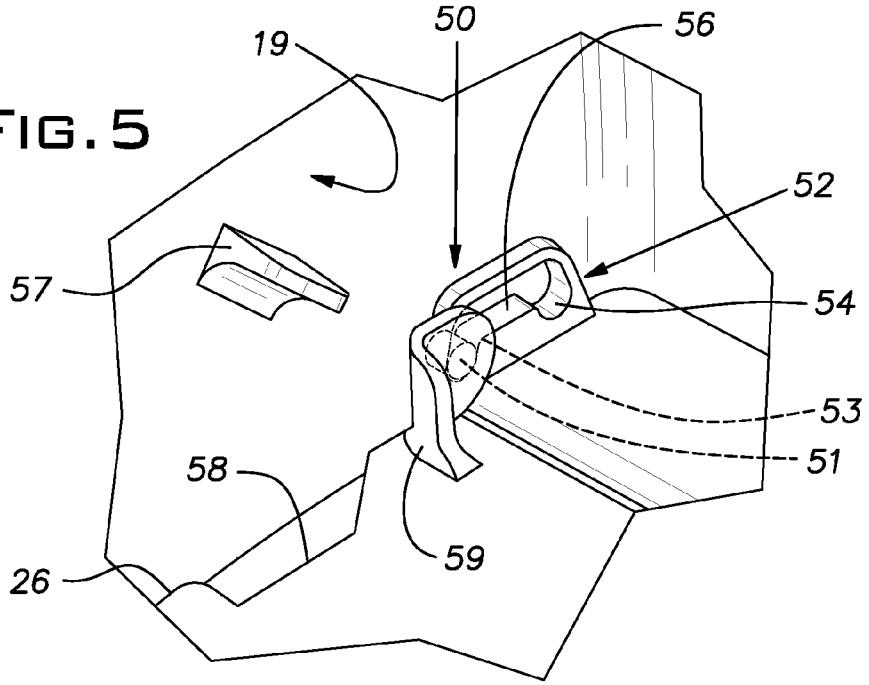
FIG. 5 is a first perspective view of examples of certain components of the storage unit of FIG. 1 that allow the storage unit to be selectively arranged in its several storage modes.
Figure 6:
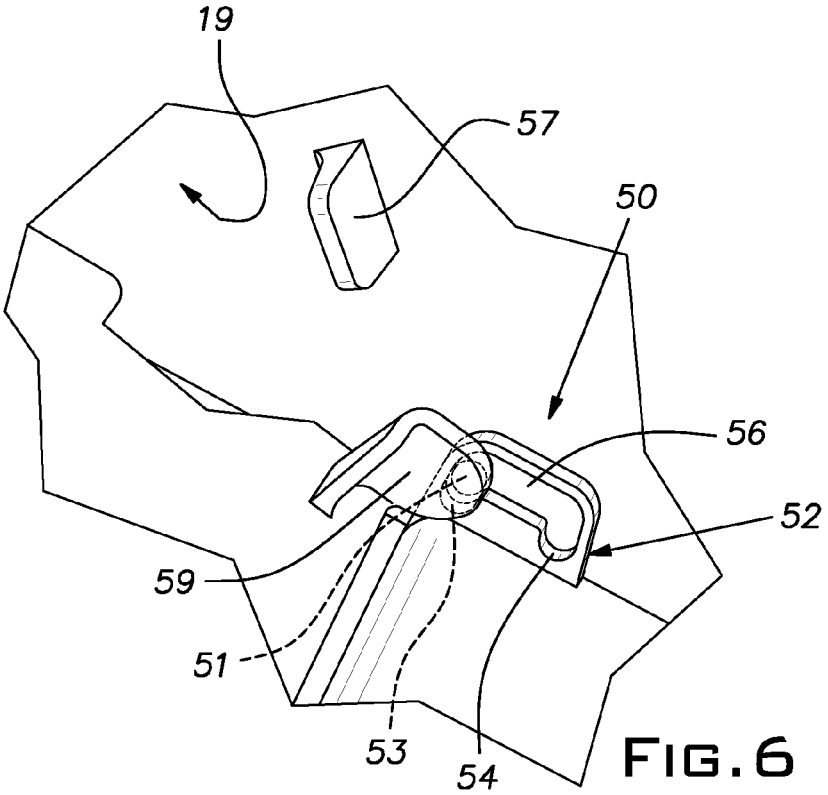
FIG. 6 is a second perspective view of the components of FIG. 5.

Referring now to FIGS. 5 and 6, the first pivotal connection 50 comprises a first pivot rod 51 that is mounted at an upstanding support 59 affixed to the divider 25 and is thereby connected at the divider first lateral side 26. The first pivot rod 51 extends outwardly from the divider first lateral side 26 into a first side wall pivot structure, indicated generally at 52, at the first side wall 19. The second pivotal connection 60 is a mirror image of the first pivotal connection 50, as can be seen in FIG. 1, so that the description of the first pivotal connection 50 that follows applies similarly to the second pivotal connection 60. Thus, the second pivotal connection 60 includes a second pivot rod that is mounted at an upstanding support affixed to the divider 25 and is thereby connected at the divider second lateral side 27. Further, the second pivot rod extends outwardly from the divider second lateral side 27 into a second side wall pivot structure at the second side wall 22. By means of these two pivotal connections, the divider 25 is selectively locatable at the first position, as shown in FIG. 2, the second position, as shown in FIG. 3, and the third position, as shown in FIG. 4, by pivotal movement of the divider 25 at the two pivotal connections.

The first side wall pivot structure 52 includes a first side wall first pivot point 53 and a first side wall second pivot point 54. The first side wall first pivot point 53 and the first side wall second pivot point 54 have a configuration similar to the configuration of the first pivot rod 51. That is, the first side wall first pivot point 53 and the first side wall second pivot point 54 are substantially circular in cross-section as is the first pivot rod 51. The first side wall first pivot point 53 and the first side wall second pivot point 54 are joined by a first slot 56 at the first side wall that is sufficiently large for the first pivot rod 51 to move between the first side wall first pivot point 53 and the first side wall second pivot point 54. Similarly, the second side wall pivot structure of the second pivotal connection 60 includes a second side wall first pivot point and a second side wall second pivot point. The second side wall first pivot point and the second side wall second pivot point have a configuration similar to the configuration of the second pivot rod. That is, the second side wall first pivot point and the second side wall second pivot point are substantially circular in cross-section as is the second pivot rod, and the second side wall first pivot point and the second side wall second pivot point are joined by a second slot at the second side wall 22 sufficiently large for the second pivot rod to move between the second side wall first pivot point and the second side wall second pivot point.

For the purpose of retaining the divider 25 at the second position, as shown in FIG. 3, at least one of a first abutment 57 is located at the first side wall 19 and a similar second abutment, not shown, is located at the second side wall 22, both within the first storage area 29. The divider 25 includes at least one of a first recess 58 at the divider first lateral side 26 and a similar second recess 68 at the divider second lateral side 27. The first recess 58 is located at the divider first lateral side 26 such that the first abutment 57 passes through the first recess 58 when the first pivot rod 51 is at the first side wall first pivot point 53 and the divider 25 is moved past the first abutment 57; and the first abutment 57 engages the divider 25 and maintains the divider at the second position when the first pivot rod 51 is at the first side wall second pivot point 54. The second recess 68 is located at the divider second lateral side 27 such that the second abutment, not shown, passes through the second recess 68 when the second pivot rod is at the second side wall first pivot point and the divider is moved past the second abutment; and the second abutment engages the divider 25 and maintains the divider at the second position when the second pivot rod is at the second side wall second pivot point.

The first side wall second pivot point 54 is located nearer the rear wall 15 than the first side wall first pivot point 54, and the second side wall second pivot point is located nearer the rear wall 15 than the second side wall first pivot point. This arrangement of the several pivot points provides for both the passage of the divider 25 by the first abutment 57 and the second abutment and the retention of the divider 25 at the first abutment 57 and the second abutment as will now be described.

It will be understood from the foregoing description that whenever the divider 25 is to be selectively located at a position such that the divider must pass the first abutment 57 through the first recess 58 and the second abutment must pass through the second recess 68 in order to reach that position, the first pivot rod 51 is placed in the first side wall first pivot point 53 and the second pivot rod is placed in the second side wall first pivot point; and whenever the divider 25 is to be supported at the first abutment 57 and the second abutment in the second position, the first pivot rod 51 is placed in the first side wall second pivot point 54 and the second pivot rod is placed in the second side wall second pivot point. The manipulation of the divider 25 between the side wall pivot points is accomplished by moving the first pivot rod 51 along the first slot 56 and the second pivot rod along the second slot; and this movement can be accomplished, for example, by grasping the divider 25 at one of the access openings 44 and sliding the divider 25 along the first and second slots. For example, from the first position shown in FIG. 2, the divider 25 is moved to the second position shown in FIG. 3 as follows. The divider 25 is first raised from the first position, with the first pivot rod 51 being located in the first side wall first pivot point 53 and the second pivot rod being located in the second side wall first pivot point, past the first abutment 57 and the second abutment, respectively, with the first abutment passing through the first recess 58 and the second abutment passing through the second recess 68. Next, the first pivot rod 51 is slid along the first slot 56 to the first side wall second pivot point 54 and the second pivot rod is slid along the second slot to the second side wall second pivot point. Thereupon, because each of the second pivot points are nearer the rear wall 15 than the respective first pivot points, the divider 25 when pivoted towards the front wall 12 will not move past the first abutment 57 and the second abutment but will engage the first abutment 57 and the second abutment and be supported and retained thereat in the second position.

The invention has been described herein above using specific examples; however, it will be understood by those skilled in the art that various alternatives may be used and equivalents may be substituted for elements or steps described herein without deviating from the scope of the invention. Thus, for example, although the invention is described in detail herein as comprising a storage unit that is distinct and separate from its surroundings, the principles of the invention apply as well in instances in which the storage unit comprises a storage area, storage location or storage site that is integrated into its surroundings; and the expression "storage unit," as used herein is intended to include such storage areas, storage locations and storage sites. For example, although the storage unit has been described as comprising a portable structure that can be alternatively mounted and removed from the inside of a refrigerator door, the storage unit can be incorporated into a refrigerator door liner as part of a unitary structure. Additionally, modifications may be necessary to adapt the invention to a particular situation or to a particular need without departing from the scope of the invention. It is intended that the invention not be limited to the particular implementation described herein, but that the claims be given their broadest interpretation to cover all embodiments, literal or equivalent, covered thereby.

What is claimed is:

1. A storage unit including at least:

a front wall;

a rear wall;

a bottom wall; and a divider selectively locatable at a first position overlying the bottom wall, thereby defining a first storage area between at least the front wall and the rear wall, a second position between the front wall and the rear wall and inclined away from the rear wall and toward the front wall, thereby defining a second storage area with at least the front wall and defining a third storage area with at least the rear wall, and a third position adjacent the rear wall, thereby at least diminishing the size of the third storage area and enlarging the size of the second storage area, wherein the bottom wall is structured to support and retain lower portions of at least two of a first group of substantially cylindrical articles at the second storage area, said articles of the first group being supported obliquely to a horizontal surface and spaced away from one another, and wherein the front wall includes a front wall free edge that is structured to support and retain upper portions of the at least two of a first group of substantially cylindrical articles at the second storage area, said articles of the first group being supported obliquely to a horizontal surface and spaced away from one another, and wherein the divider includes a divider free edge that is structured to support and retain upper portions of at least two of a second group of substantially cylindrical articles at the third storage area, said articles of the second group being supported obliquely to a horizontal surface and spaced away from one another.

2. A refrigeration appliance including the storage unit of claim 1.

3. The refrigeration appliance of claim 2 including a door for opening and closing access to an interior of the refrigeration appliance, the storage unit being located at the inside of the door.

4. The storage unit of claim 1 wherein the divider free edge includes at least one access opening at which one of an individual's finger and a tool can be inserted and the divider thereby selectively located at one of the first position, the second position and the third position.

5. The storage unit of claim 1 including:

a first side wall having a first side wall first lateral end and a first side wall second lateral end;

a second side wall having a second side wall first lateral end and a second side wall second lateral end; wherein the front wall includes a front wall first lateral end and a front wall second lateral end and the front wall free edge extends between the front wall first lateral end and the front wall second lateral end, the rear wall includes a rear wall first lateral end and a rear wall second lateral end, the first side wall first lateral end is joined to the front wall first lateral end and the first side wall second lateral end is joined to the rear wall first lateral end, the second side wall first lateral end is joined to the front wall second lateral end and the second side wall second lateral end is joined to the rear wall second lateral end, the divider includes a divider first lateral side and a divider second lateral side, and the divider is pivotally connected at at least one of a first pivotal connection between the divider first lateral side and the first side wall and a second pivotal connection between the divider second lateral side and the second side wall.

6. The storage unit of claim 5 wherein the first pivotal connection includes a first pivot rod that is connected at the divider first lateral side and extends outwardly from the divider first lateral side into a first side wall pivot structure at the first side wall, and the second pivotal connection includes a second pivot rod that is connected at the divider second lateral side and extends outwardly from the divider second lateral side into a second side wall pivot structure at the second side wall, whereby the divider is selectively locatable at one of the first position, the second position and the third position by pivotal movement of the divider.

7. The storage unit of claim 6 wherein the first side wall pivot structure includes a first side wall first pivot point and a first side wall second pivot point, the first side wall first pivot point and the first side wall second pivot point having a configuration similar to the configuration of the first pivot rod and being joined by a first slot sufficiently large for the first pivot rod to move between the first side wall first pivot point and the first side wall second pivot point, and the second side wall pivot structure includes a second side wall first pivot point and a second side wall second pivot point, the second side wall first pivot point and the second side wall second pivot point having a configuration similar to the configuration of the second pivot rod and being joined by a second slot sufficiently large for the second pivot rod to move between the second side wall first pivot point and the second side wall second pivot point.

8. The storage unit of claim 7 including at least one of a first abutment located at the first side wall within the first storage area and a second abutment located at the second side wall within the first storage area, the first abutment supporting and retaining the divider at the first position and the second abutment retaining the divider at the second position.

9. The storage unit of claim 8 wherein the divider includes at least one of a first recess at the divider first lateral side and a second recess at the divider second lateral side, the first recess being located at the divider first lateral side such that the first abutment passes through the first recess when the first pivot rod is at the first side wall first pivot point and the divider is moved past the first abutment and the first abutment engages the divider and supports and retains the divider at the second position when the first pivot rod is at the first side wall second pivot point, and the second recess being located at the divider second lateral side such that the second abutment passes through the second recess when the second pivot rod is at the second side wall first pivot point and the divider is moved past the second abutment and the second abutment engages the divider and supports and retains the divider at the second position when the second pivot rod is at the second side wall second pivot point.

10. The storage unit of claim 9 wherein the first side wall second pivot point is located nearer the rear wall than the first side wall first pivot point and the second side wall second pivot point is located nearer the rear wall than the second side wall first pivot point.

11. A refrigeration appliance including the storage unit of claim 10.

12. The refrigeration appliance of claim 11 including a door for opening and closing access to an interior of the refrigeration appliance, the storage unit being located at an inside of the door.

13. A storage unit including:

a front wall;

a rear wall; and a divider locatable between the front wall and the rear wall and inclinable away from the rear wall and toward the front wall, wherein the front wall includes a front wall free edge that is structured to support and retain upper portions of at least two of a first group of substantially cylindrical articles in a storage area between the front wall and the divider, said articles of the first group being supported obliquely to a horizontal surface and spaced away from one another, and the divider includes a divider free edge that is structured to support and retain upper portions of at least two of a second group of substantially cylindrical articles in a storage area between the divider and the rear wall, said articles of the second group being supported obliquely to a horizontal surface and spaced away from one another.

14. The storage unit of claim 13 including a bottom wall structured to support and retain lower portions of the at least two of a first group of substantially cylindrical articles in the storage area between the front wall and the divider, said articles of the first group being supported obliquely to a horizontal surface and spaced away from one another.

15. A refrigeration appliance including a door for opening and closing access to an interior of the refrigeration appliance, the storage unit of claim 13 being located at an inside of the door.

* * * * *